US006706680B2

(12) United States Patent
Fender et al.

(10) Patent No.: US 6,706,680 B2
(45) Date of Patent: Mar. 16, 2004

(54) USE OF QUATERNARY POLYSILOXANES IN LAUNDRY DETERGENT FORMULATIONS

(75) Inventors: Michael Fender, Flieden (DE); Sascha Oestreich, Essen (DE)

(73) Assignee: Goldschmidt Rewo GmbH & Co. KG, Steinau A.D. Str. (DE)

( * ) Notice: Subject to any disclaimer, the term of this patent is extended or adjusted under 35 U.S.C. 154(b) by 327 days.

(21) Appl. No.: 09/971,556

(22) Filed: Oct. 5, 2001

(65) Prior Publication Data

US 2002/0068689 A1 Jun. 6, 2002

(30) Foreign Application Priority Data

Oct. 16, 2000 (DE) ..... 100 51 258

(51) Int. Cl.[7] ..... C11D 1/62; C11D 1/82

(52) U.S. Cl. ..... 510/504; 510/276; 510/287; 510/329; 510/330; 510/466; 510/504

(58) Field of Search ..... 510/276, 287, 510/329, 330, 466, 504

(56) References Cited

FOREIGN PATENT DOCUMENTS

| | | | |
|---|---|---|---|
| DE | 3719086 | * | 10/1988 |
| DE | 37 19 086 | C1 | 10/1988 |
| EP | 0 151 938 | A2 | 8/1985 |
| EP | 282720 | * | 2/1988 |
| EP | 0 282 720 | A2 | 9/1988 |

* cited by examiner

*Primary Examiner*—Charles Boyer
(74) *Attorney, Agent, or Firm*—Scully, Scott, Murphy & Presser

(57) ABSTRACT

The invention provides for the use of quaternary polysiloxanes of the general formula (I)

(I)

and/or cyclic quaternary polysiloxanes of the general formula (IIa)

(IIa)

and/or linear quaternary polysiloxanes of the general formula (IIb)

(IIb)

in laundry detergent formulations.

13 Claims, 1 Drawing Sheet

Soft hand - test results

Soft hand - test results

USE OF QUATERNARY POLYSILOXANES IN LAUNDRY DETERGENT FORMULATIONS

FIELD OF THE INVENTION

The present invention relates to laundry detergents, and more particularly to laundry detergent formulations that include at least one quaternary polysiloxane compound.

BACKGROUND OF THE INVENTION

Drum-type washing machines which are common in European households, generally wash in two operations. In the main wash cycle, the laundry is first cleaned by means of a detergent (powder or liquid). The main wash cycle is typically followed by two or more rinses with clear water. A fabric softener may be added to the last of these rinses for the purpose of after-treatment. The softener is intended to give the laundry a soft, fleecy feel.

It is known that laundry detergent formulations based on anionic, nonionic and/or amphoteric surfactants, although they clean the laundry, do not have a sufficient softening effect on the textiles. If the consumer desires soft textiles after the wash, then the textiles must pass through a further softening cycle after the main wash cycle.

Attempts to combine the two laundry treatments in one operation in order to spare the housewife multiple dosing have already been made in large numbers.

Various classes of compounds may be used in order to bring about a softening effect in textiles. In the majority of cases, however, cationic surfactants are used, since the preparation of cationic surfactants is cheap and such surfactants produce a softening effect on the textiles even at very low concentrations.

The use of cationic and anionic surfactants simultaneously in order to obtain both a cleaning effect and a softening effect during the wash is generally accompanied, however, by the formation of anion-cation complexes, which not only reduce the cleaning effect of the laundry detergent, but at the same time reduce the desired softening effect.

In order to avoid the formation of an anion-cation complex, the wash cycle and softening cycle are usually performed at separate times.

The consumer is now to be provided with a product which is easier to handle and which replaces multiple dosing operations by a dosing operation which need only be carried out once.

EP-A-0 151 938 describes, for example, "two in one" laundry detergent formulations, in which anionic surfactants and quaternary alkyl ammonium surfactants are combined with the aid of carrier materials.

In this case, direct contact between anionic and quaternary surfactants is prevented by the quaternary surfactants being present in a form in which they are adsorbed on the carrier materials. The carrier/quat system which goes onto the fiber in the washing operation is separated only after the anionic surfactants have been rinsed out.

Such systems have the disadvantage, however, that the softening effect is observable only to a limited extend in comparison with the separate dosing of fabric softeners. It is desirable, furthermore, to provide homogeneous systems in which the carrier materials do not need to be given long-term stabilization by means of further auxiliaries.

In addition, polydimethylsiloxanes may be used as a softening component in two-in-one laundry detergent formulations. If it is desired to combine the washing operation and softening operation, however, such formulations have the disadvantage that polydimethylsiloxanes, owing to their high hydrophobicity and oleophobicity, lead to deposits and build-up effects in the washing machine and on the laundry.

When the polydimethyl siloxones are deposited or built-up on the laundry, this has the effect of greatly reducing the wettability of the fiber by body moisture and of giving an unpleasant "greasy" feel on the skin after just a few applications.

Quaternary polysiloxanes are likewise known and are described, for example, in EP-A-0 282 720 and in DE-A-37 19 086. Such compounds have been known to date for their conditioning properties in hair cosmetology.

The skilled worker does not expect such quaternary poly-siloxanes to be combinable with anionic surfactants, since anion-cation complexes ought to occur.

It is the object of the present invention to provide laundry detergent formulations which combine the washing operation and softening operation and which after the wash leave a distinctly measurable softening effect in the textiles.

SUMMARY OF THE INVENTION

It has surprisingly now been found that the addition of quaternary polysiloxanes to anionic laundry detergent formulations leaves a distinctly measurable softening effect on the textiles but does not exhibit any visible precipitate of anion-cation complexes or build-up effect on the treated laundry. A further advantage is that the quaternary polysiloxanes used in accordance with the present invention are compatible with the detergent substances that are commonly used, and normally require no additional auxiliaries for incorporation.

The present invention accordingly provides for the use of quaternary polysiloxanes of the general formula (I)

(I)

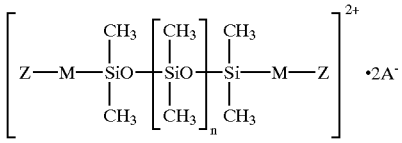

and/or cyclic quaternary polysiloxanes of the general formula (IIa)

(IIa)

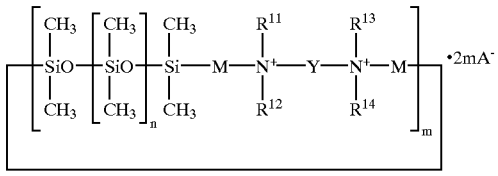

and/or linear quaternary polysiloxanes of the general formula (IIb)

(IIb)

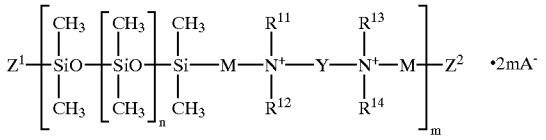

where

M is a divalent hydrocarbon radical of at least 4 carbon atoms which contains a hydroxyl group and may be interrupted by at least one oxygen atom, the nitrogen atom of the radical Z being connected to the radical M via the carbon atom adjacent to the C—OH group in the radical M, Z is a radical

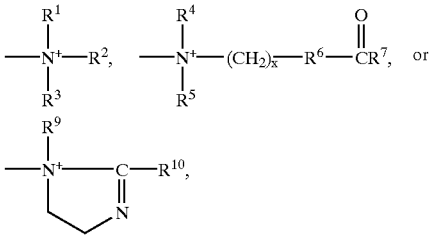

$R^1$, $R^2$, $R^3$=alkyl radicals of 1 to 22 carbon atoms or alkenyl radicals of 2 to 22 carbon atoms, it is possible for the alkyl or alkenyl radicals to contain hydroxyl groups, and at least one of the radicals $R^1$, $R^2$ and $R^3$ has at least 10 carbon atoms, $R^4$, $R^5$, $R^7$, $R^9$, $R^{10}$=alkyl radicals of 1 to 22 carbon atoms or alkenyl radicals of 2 to 22 carbon atoms, it is possible for the alkyl or alkenyl radicals to contain hydroxyl groups, $R^6$=—O— or —$NR^8$—radical, $R^8$=alkyl or hydroxyalkyl radical of 1 to 4 carbon atoms or hydrogen, x=2to 4, n=a number from 0 to 200, $A^-$=an organic or inorganic anion originating from a customary physiologically acceptable acid HA, $Z^1$=an H, OH, alkyl or alkoxy radical, or has the definition of a hydrocarbon radical of at least 4 carbon atoms which contains one or more hydroxyl groups and may be interrupted by one or more oxygen atoms, or has the definition of the radical

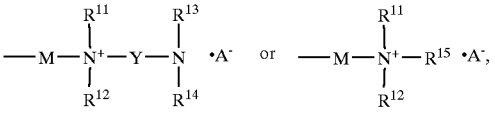

$Z_2$=the group

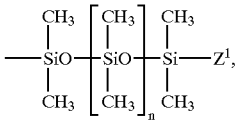

Y=a divalent hydrocarbon radical of at least 2 carbon atoms which may contain a hydroxyl group and which may be interrupted by at least one oxygen or nitrogen atom, $R^{11}$, $R^{12}$, $R^{13}$, $R^{14}$=identical or different and are alkyl radicals of 1 to 4 carbon atoms or benzyl radicals or in each case $R^{11}$ and $R^{13}$ or $R^{12}$ and $R^{14}$ may be components of a bridging alkylene radical, $R^{15}$=an alkyl radical of 1 to 20 carbon atoms, m=integer greater than or equal to 1, in laundry detergent formulations.

DETAILED DESCRIPTION OF THE PRESENT INVENTION

Figure 1:
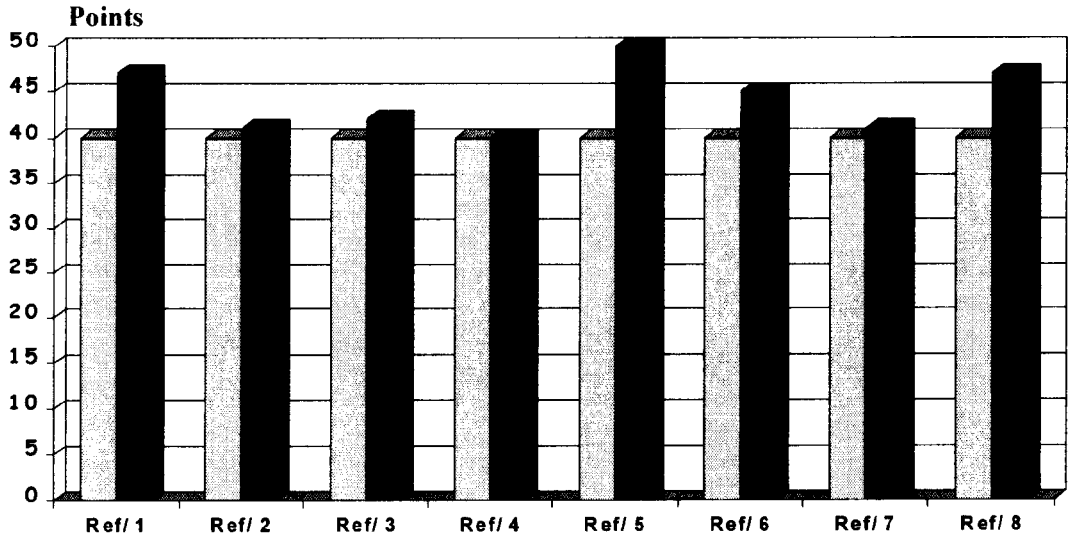
FIG. 1 is a plot showing the softening properties of inventive formulations 1–8 as compared with a reference formulation (Ref).

As stated above, the present inventive relates to laundry detergent formulations which include at least one quaternary polysiloxane of formula (I) and/or (IIa) and/or (IIb).

In one preferred embodiment of the present invention, the quaternary polysiloxanes are compounds wherein n is a number in the range from 0 to 150, in particular from 5 to 100, x is a number in the range from 2 to 4, and m is a number in the range from 1 to 10, in particular from 1 to 5.

The skilled worker is well aware that the compounds are in the form of a mixture having a distribution which is governed substantially by the laws of statistics. The values for the indices n and m therefore represent average values.

Examples of the radical M, a divalent hydrocarbon radical of at least 4 carbon atoms which contains a hydroxyl group and which may be interrupted by at least one oxygen atom, the nitrogen atom of the radical Z being connected with the radical M via the carbon atom adjacent to the C—OH group in the radical M, are

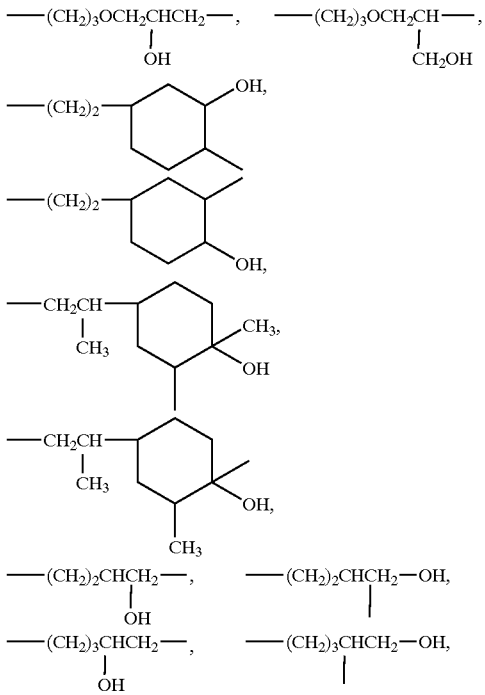

-continued

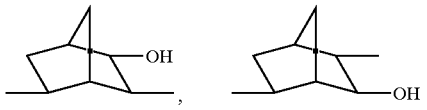

Within the compounds of the present invention, the two radicals Z may have the same or a different definition.

Examples of the radicals $R^1$, $R^2$, $R^3$, i.e., alkyl radicals of 1 to 22 carbon atoms or alkenyl radicals of 2 to 22 carbon atoms, where the alkyl or alkenyl radicals may contain hydroxyl groups and at least one of the radicals $R^1$, $R^2$, $R^3$ has at least 10 carbon atoms, include: alkyl radicals, such as the methyl, ethyl, octyl, dodecyl, hexadecyl or octadecyl radical; hydroxyalkyl radicals, such as the hydroxyethyl radical; and alkenyl radicals, such as the allyl or vinyl radical.

Examples of the radicals $R^4$, $R^5$, $R^7$, $R^9$, $R^{10}$, i.e., alkyl radicals of 1 to 22 carbon atoms or alkenyl radicals of 2 to 22 carbon atoms, it is possible for the alkyl or alkenyl radicals to contain hydroxyl groups, include: alkyl radicals, such as the methyl, ethyl, octyl, dodecyl, hexadecyl or octadecyl radical; hydroxyalkyl radicals, such as the hydroxyethyl radical; and alkenyl radicals, such as the allyl or vinyl radical.

Examples of $R^8$, i.e., the alkyl or hydroxyalkyl radical of 1 to 4 carbon atoms or hydrogen, include: hydrogen; alkyl radicals, such as the methyl, ethyl, isopropyl or butyl radical; and hydroxyalkyl radicals, such as the hydroxyethyl radical.

Examples of $A^-$, i.e., an organic or inorganic anion originating from a common physiologically acceptable acid HA, are $Cl^-$, $Br^-$, $SO_4^{2-}$, $HSO_4^-$, $H_3CSO_4^-$, $H_3CCO_2^-$, citrate and tosylate.

Examples of the radical $Z^1$ include: H—, HO—, $H_3C—CH_2O—$, $(H_3C)_2CHO—$, $H_3C(CH_2)_7—$,

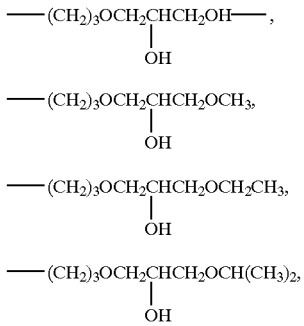

-continued

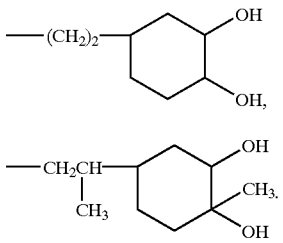

Examples of Y, i.e., a divalent hydrocarbon radical of at least 2 carbon atoms which may contain a hydroxyl group and which may be interrupted by at least one oxygen or nitrogen atom, include: $—(CH_2)_2—$, $—(CH_2)_3—$, $—(CH_2)_6—$, $—(CH_2)_{12}—$, $—(CH_2)_2—O—(CH_2)_2—$, $—CH_2—O—CH_2—$,

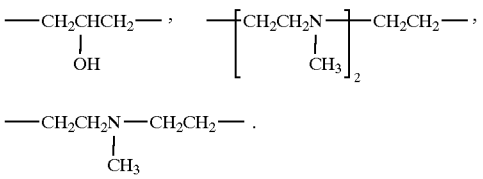

Examples of the radicals $R^{11}$, $R^{12}$, $R^{13}$, $R^{14}$, which are identical or different and are alkyl radicals of 1 to 4 carbon atoms or benzyl radicals, or in each case $R^{11}$ and $R^{13}$ or $R^{12}$ and $R^{14}$ may be components of a bridging alkylene radical, include: alkyl radicals, such as methyl, ethyl, isopropyl or butyl radicals, and benzyl radicals, such as the benzyl radical. If, in each case, $R^{11}$ and $R^{13}$ or $R^{12}$ and $R^{14}$ are components of a bridging alkylene radical, then this molecular moiety may adopt the following structure:

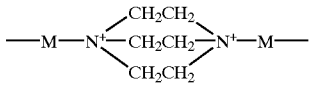

Particularly preferred examples of the radicals $R^{11}$, $R^{12}$, $R^{13}$, $R^{14}$ are the methyl and ethyl radical.

Examples of $R^{15}$, i.e., an alkyl radical of 1 to 20 carbon atoms, include: alkyl radicals, such as the methyl, ethyl, octyl, dodecyl, hexadecyl or octadecyl radical.

Examples of the quaternary polysiloxanes used in accordance with the present invention include:

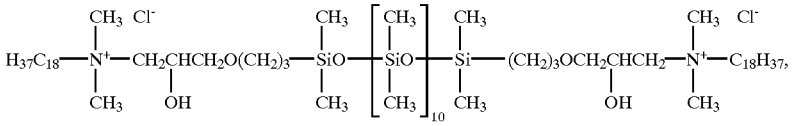

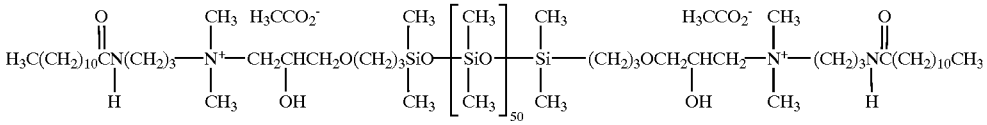

-continued
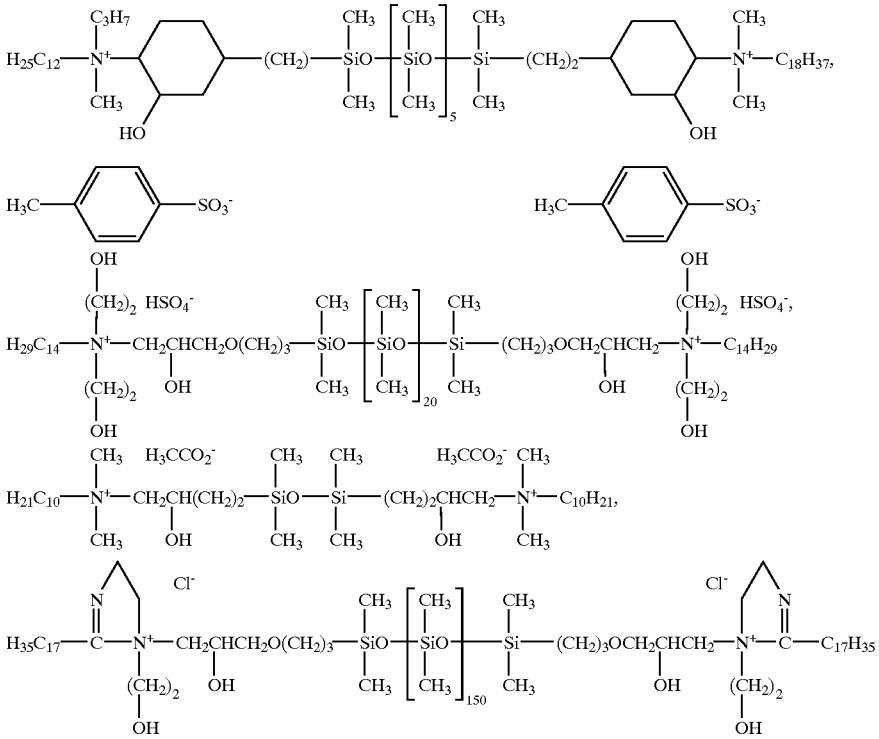
Examples of cyclic quaternary polysiloxanes used in accordance with the present invention include:
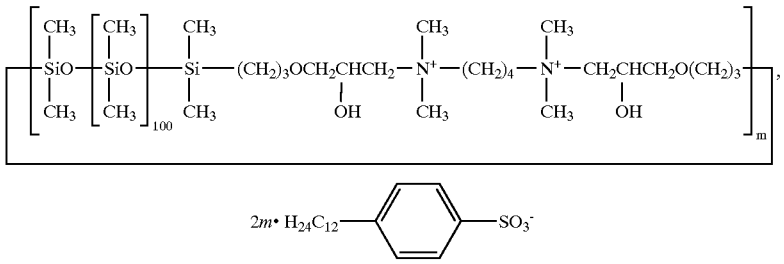
$m > 1$
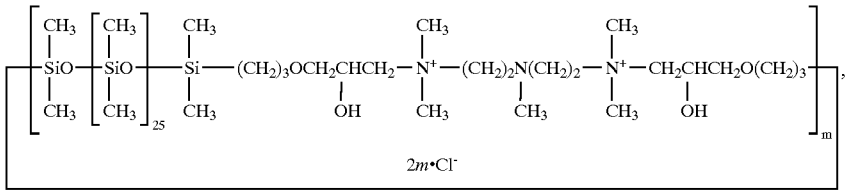
$m > 1$
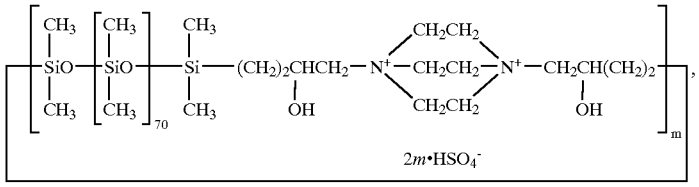
$m > 1$ -continued
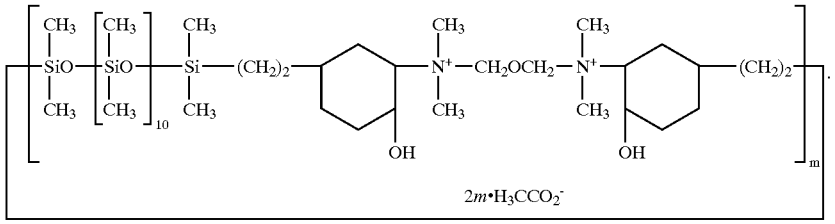
$m > 1$
Examples of the linear quaternary polysiloxanes used in accordance with the present invention include:
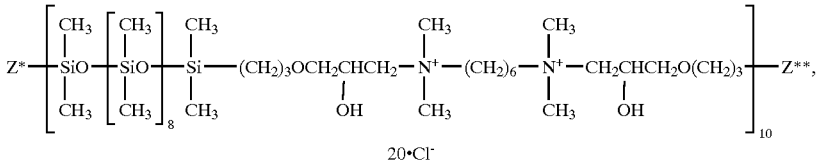
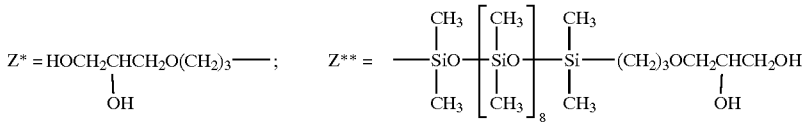
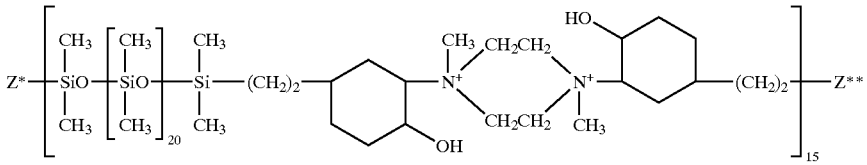
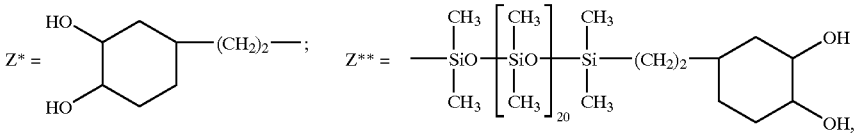
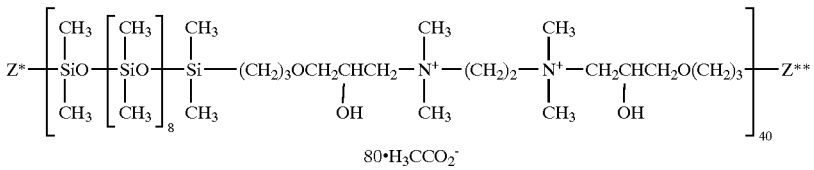
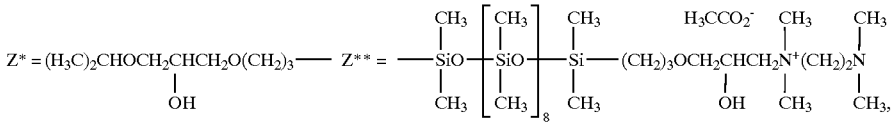

-continued

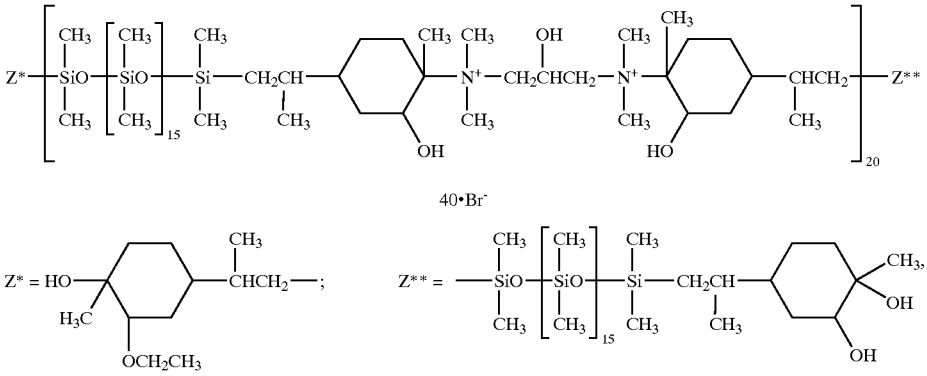

Laundry detergents employed in the present invention include any formulations typically available in this field. The laundry detergents employed may be in the form of powders, granules, beads, tablets, pastes, gels or liquids. The laundry detergents are formulated predominantly as heavy-duty detergents for universal use and comprise substantially solid or liquid carrier materials and various functional ingredients such as surfactants, inorganic polymeric builders, enzymes, bleaching systems, optical brighteners, soil release polymers, foam inhibitors, fillers, processing aids, and stabilizers.

Surfactants employed in the present invention are predominantly anionic compounds such as alkylbenzenesulfonates (LAS) alone or in combination with fatty alcohol polyglycol ethers, fatty alcohol sulfates, α-olefinsulfonates, ester sulfates and, more recently, alkyl polyglycosides (APGs) and fatty acid glucamides (GA) as well;

builders used in the present invention include: zeolites, polycarboxylates, polyvinyl-pyrrolidones and amorphous anhydrous sodium silicates and phyllosilicates, with citric acid often being employed as a cobuilder;

components of the bleaching systems are, in particular, perborates and sodium percarbonate, accompanied by the use of N-acetyl compounds, N,N,N',N'-tetraacetylethylenediamine or p-nonyloxybenzenesulfonate as activators;

optical brighteners used in the present invention include: stilbenes and distyryl-biphenyls, and enzymes employed include: proteases, amylases, cellulases and, in some cases, lipases.

These and further components and their formulations are part of the known prior art and comprise the functional ingredients in appropriate amounts depending on the field of use. The typical composition of universal laundry detergents in western Europe in 1998 is shown in the table below.

| Component | Liquid laundry detergent [%] A | Powder laundry detergent [%] B |
|---|---|---|
| Surfactants | 20–50 | 10–15 |
| Builders | 1–15 | 25–50 |
| Cobuilders | 0–5 | 3–5 |
| Bleaches | — | 10–25 |
| Bleach activators | — | 1–3 |
| Antiredeposition additives | 0–1 | 0–1 |
| Corrosion inhibitors | 2–6 | 2–6 |

-continued

| Component | Liquid laundry detergent [%] A | Powder laundry detergent [%] B |
|---|---|---|
| Stabilizers | 0–1 | 0–1 |
| Foam inhibitors | — | 0.1–4.0 |
| Enzymes | 0.5–2 | 0.3–0.8 |
| Optical brighteners | 0.1–0.3 | 0.1–0.3 |
| Soil repellents | +/– | +/– |
| Fillers/processing aids | — | 5–30 |
| Water | ad 100 | ad 100 |

Performance Comparison:

The composition of the test formulations used is as follows:

| | |
|---|---|
| Liquid detergent base (component A): | |
| Anionic surfactants (Na alkylbenzenesulfonate) | 21.75% |
| Soap | 16.50% |
| Nonionic surfactants | 10.60% |
| Amphoteric surfactants | 1.40% |
| 1,2-Propylene glycol | 11.20% |
| Water | ad 100% |
| Powder detergent base (component B): | |
| Anionic surfactants (Na alkylbenzenesulfonate) | 15% |
| Pentasodium pyrophosphate | 30% |
| Sodium perborate | 28% |
| Optical brightener | 0.1% |
| Carboxymethylcellulose | 0.5% |
| Waterglass | 3.0% |
| Foam inhibitors | 2.0% |
| EDTA | 0.2% |
| Perfume | 0.1% |
| Dye | 0.7% |
| Sodium sulfate and standardizers | 17% |
| Water | ad 100% |

Reference Detergent:

85 parts of component B were admixed with 15 parts of a mixture consisting of 33.3% by weight of a silica (Sipernat 50, Degussa) and 66.66% by weight of a tallow-amidoethylimidazolinium methosulfate.

Quaternary polysiloxanes used in accordance with the present invention were compounds having the following structures:

(III)

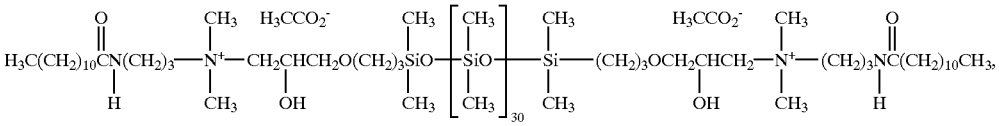

(IV)

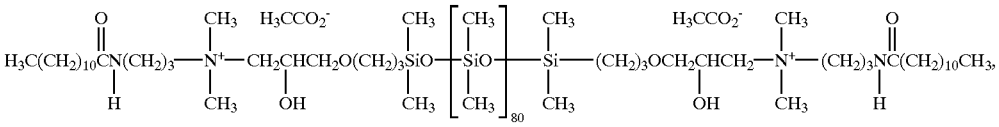

(V)

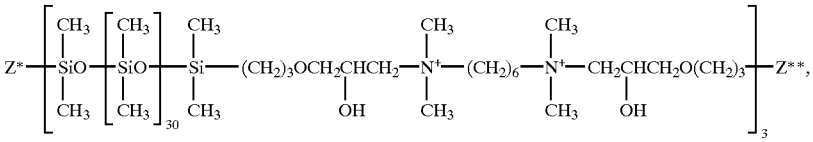

$6 \cdot H_3CCO_2^-$

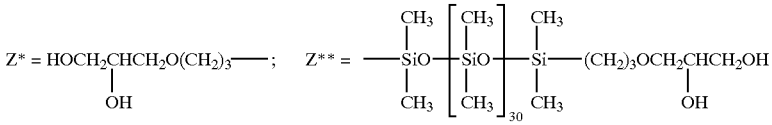

(VI)

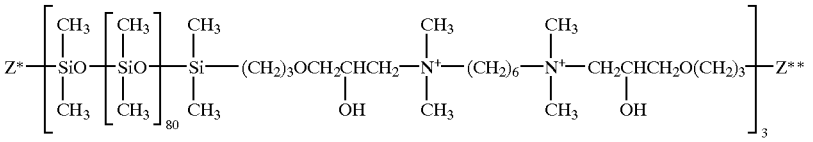

$6 \cdot H_3CCO_2^-$

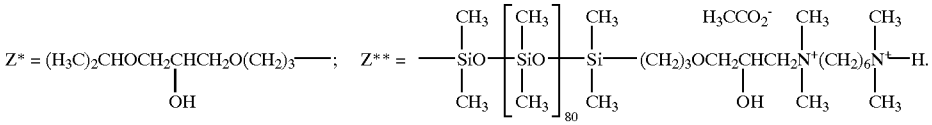

The skilled worker is aware that the abovementioned compounds are present in the form of a mixture having a distribution governed substantially by the laws of statistics. The abovementioned formulae can therefore only show average values.

The abovementioned compounds are prepared in an industrial process in accordance with the details described in EP-A-0 282 720 and in DE-A-37 19 086.

The skilled worker is also aware that the end groups Z* and Z**, owing to side reactions, are subject to structural variations and therefore are shown only by way of example here.

The following examples are given to illustrate the present invention as well as to demonstrate some advantages that are obtained therefrom.

EXAMPLES

| | | |
|---|---|---|
| (1) | Component A) | 95% |
| | Formula (III) | 5% |
| (2) | Component A) | 97.5% |
| | Formula (III) | 3.5% |

-continued

| | | |
|---|---|---|
| (3) | Component B) | 97.5% |
| | Formula (III) | 3.5% |
| (4) | Component B) | 97.5% |
| | Formula (V) | 3.5% |
| (5) | Component A) | 95% |
| | Formula (IV) | 5% |
| (6) | Component A) | 97.5% |
| | Formula (IV) | 2.5% |
| (7) | Component B) | 97.5% |
| | Formula (IV) | 2.5% |
| (8) | Component B) | 97.5% |
| | Formula (VI) | 2.5% |

Tests:

To test the softness of the treated fabric, the textiles were washed in a normal household washing machine. The dosing of laundry detergent was different depending on the type of base, but was guided by the standard dosing recommendations for water hardness range II and laundry with normal soiling. After the washing operation, the laundry was dried statically (on a washing line) and examined and evaluated by means of a test panel.

| Test conditions: | |
|---|---|
| Machine: | Miele W 715, W 719, W 918 |
| Test fabric: | Woven cotten terry fabric, Frottana, Fb. 901; 100 × 50 cm |
| Ballast fabric: | Smooth woven cotton fabric |
| Laundry detergent: | Liquid detergent base (component A)<br>Powder detergent base (component B)<br>Reference detergent (Ref) |
| Dosage: | In accordance with dosing recommendation for laundry with normal soiling |
| After treatment: | None |
| Drying period: | 24 hours under standard climatic conditions |

Evaluation:

After the towels have been dried they are cut into 10 individual swatches and stored in a climate-controlled area until their final evaluation by the test panel. The individual test formulations are always evaluated in direct comparison to the reference (market product=MP). For the evaluation of the softness, the testers are able to award ratings, with 5 representing the best evaluation and 0 the worst.

With ten individual testers who evaluate a product in a screening test, therefore, the maximum rating is a score of 50. The results of this testing are shown in FIG. 1. As shown in FIG. 1, the inventive formulations 1–8 exhibited softness that was comparable or greater than the Ref formulation.

While the present invention has been particularly shown and described with respect to preferred embodiments thereof, it will be understood by those skilled in the art that the foregoing and other changes in form and detail may be made without departing from the spirit and scope of the present invention. It is therefore intended that the present invention not be limited to the exact forms described and illustrated, but fall within the scope of the appended claims.

What is claimed is:

1. A laundry detergent formulation comprising at least one quaternary polysiloxane of general formula (I)

(I)

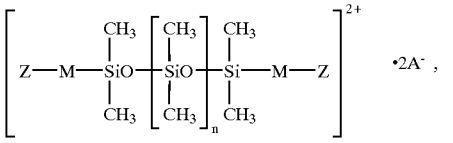

cyclic quaternary polysiloxanes of the general formula (IIa)

(IIa)

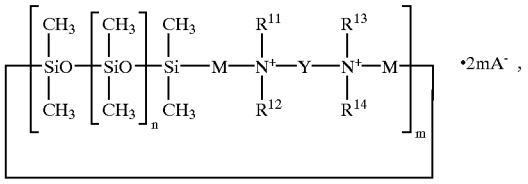

linear quaternary polysiloxanes of the general formula (IIb)

(IIb)

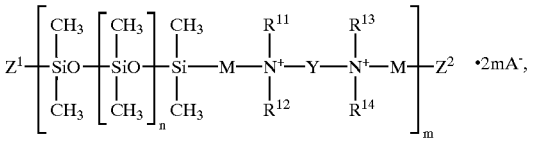

and mixtures of formulas (I), (IIa) and (IIb), where

M is a divalent hydrocarbon radical of at least 4 carbon atoms which contains a hydroxyl group and may be interrupted by at least one oxygen atom, the nitrogen atom of the radical Z being connected to the radical M via the carbon atom adjacent to the C—OH group in the radical M, Z is a radical

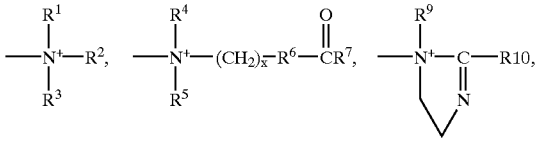

$R^1$, $R^2$, $R^3$=alkyl radicals of 1 to 22 carbon atoms or alkenyl radicals of 2 to 22 carbon atoms, and at least one of the radicals $R^1$, $R^2$ and $R^3$ has at least 10 carbon atoms, $R^4$, $R^5$, $R^7$, $R^9$, $R^{10}$=alkyl radicals of 1 to 22 carbon atoms or alkenyl radicals of 2 to 22 carbon atoms, $R^6$=—O— or —$NR^8$—radical, $R^8$=alkyl or hydroxyalkyl radical of 1 to 4 carbon atoms or hydrogen, x=2 to 4, n=a number from 0 to 200, $A^-$=an organic or inorganic anion originating from a customary physiologically acceptable acid HA, $Z^1$=an H, OH, alkyl or alkoxy radical, or has the definition of a hydrocarbon radical of at least 4 carbon atoms which contains one or more hydroxyl groups and may be interrupted by one or more oxygen atoms, or has the definition of the radical

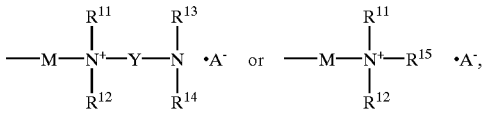

$Z^2$=the group

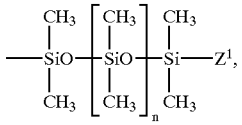

Y=a divalent hydrocarbon radical of at least 2 carbon atoms which may contain a hydroxyl group and which may be interrupted by at least one oxygen or nitrogen atom, $R^{11}$, $R^{12}$, $R^{13}$, $R^{14}$=identical or different and are alkyl radicals of 1 to 4 carbon atoms or benzyl radicals or in each case $R^{11}$ and $R^{13}$ or $R^{12}$ and $R^{14}$ may be components of a bridging alkylene radical, $R^{15}$=an alkyl radical of 1 to 20 carbon atoms, m=integer greater than or equal to 1.

2. The laundry detergent formulation of claim 1 wherein said at least one quaternary polysiloxane is a polysiloxane of general formula (I) where n is a number in the range from 0 to 150, and x is a number in the range from 2 to 4.

3. The laundry detergent formulation of claim 2 wherein n is from 5 to 100.

4. The laundry detergent formulation of claim 1 wherein said at least one quaternary polysiloxane is a polysiloxane of general formula (IIa) or (IIb) where n is a number in the range from 0 to 150, x is a number in the range from 2 to 4, and m is a number in the range from 1 to 10.

5. The laundry detergent formulation of claim 4 wherein n is from 5 to 100.

6. The laundry detergent formulation of claim 4 wherein n is from 1 to 5.

7. The laundry detergent formulation of claim 1, wherein the radical M is selected from the following group:

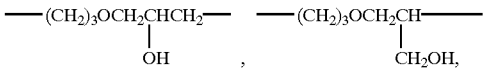

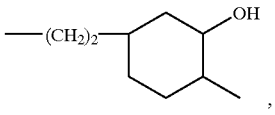

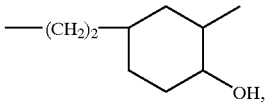

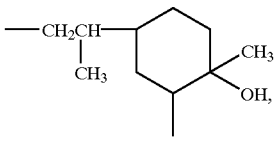

-continued

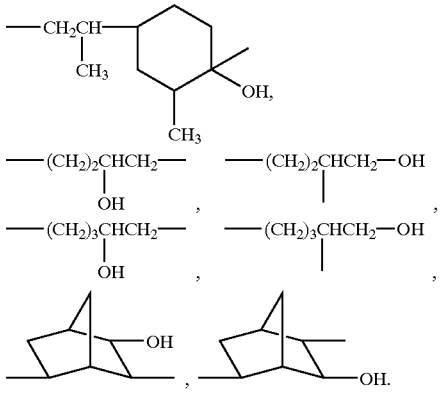

8. The laundry detergent formulation of claim 1, wherein Z is a radical of the general formula

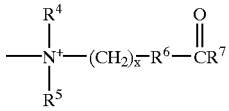

in which x=3, $R^6$=—NH—, and $R^7$=an alkyl radical of 8 to 18 carbon atoms.

9. The laundry detergent formulation of claim 1 wherein Y is a divalent hydrocarbon radical of 3 to 12 carbon atoms.

10. The laundry detergent formulation of claim 1 wherein $R^1$, $R^2$, $R^3$ are alkyl or alkenyl radicals that contain hydroxyl groups.

11. The laundry detergent formulation of claim 1 wherein $R^4$, $R^5$, $R^7$, $R^9$, $R^{10}$ are alkyl or alkenyl radicals that contain hydroxyl groups.

12. The laundry detergent formulation of claim 1, further comprising at least one solid carrier material.

13. The laundry detergent formulation of claim 12, wherein the solid carrier materials are selected from the group consisting of silicas, silicates, sodium silicates, bentonites, filler silicates, zeolites, and montmorillonites.

* * * * *